United States Patent [19]

Lemmen

[11] Patent Number: 4,873,963

[45] Date of Patent: Oct. 17, 1989

[54] ARROW SLING DEVICE, AND METHODS OF CONSTRUCTING AND UTILIZING SAME

[76] Inventor: Arie W. Lemmen, 401 Howard Ave., Lot 4, Holland, Mich. 49424

[21] Appl. No.: 131,566

[22] Filed: Dec. 11, 1987

[51] Int. Cl.[4] ..... F41B 3/00

[52] U.S. Cl. ..... 124/20 B; 124/20 R; 124/21; 124/35 R; 124/87

[58] Field of Search ..... 124/20 B, 20 R, 21, 124/22, 87, 1, 35 A, 35 R, 31, 36, 41 A, 87

[56] References Cited

U.S. PATENT DOCUMENTS

| | | | |
|---|---|---|---|
| 1,188,027 | 6/1916 | Widdop | 124/20 R |
| 2,667,863 | 2/1954 | Styles | 124/20 R |
| 3,018,770 | 1/1962 | Saunders | 124/20 B |
| 3,410,644 | 11/1968 | McLendon | 124/87 |
| 3,517,657 | 6/1970 | Alban | 124/20 B |
| 3,918,427 | 11/1975 | Turner | 124/20 B |
| 4,206,740 | 6/1980 | Lydon | 124/25 |
| 4,236,497 | 12/1980 | Troncoso, Jr. | 124/41 A |
| 4,373,503 | 2/1983 | Saunders | 124/20 R |
| 4,759,337 | 7/1988 | Suski | 124/41 A |

FOREIGN PATENT DOCUMENTS

| | | | |
|---|---|---|---|
| 626306 | 8/1961 | Canada | 124/35 A |
| 1556026 | 1/1969 | France | 124/20 B |
| 907389 | 2/1982 | U.S.S.R. | 124/87 |

*Primary Examiner*—Randolph A. Reese
*Assistant Examiner*—Anthony Knight
*Attorney, Agent, or Firm*—Irving M. Weiner; Joseph P. Carrier; Robert M. Petrik

[57] ABSTRACT

An arrow sling device having a generally slingshot configuration designed for shooting arrows. The main body of the device supports a releasable arrow guide member, has an adjustable sight member mounted thereon, and has the ends of a sling member attached thereto. The sling member is provided with a centrally positioned arrow pouch for centering and gripping the rear end of an arrow.

18 Claims, 1 Drawing Sheet

Fig. 1
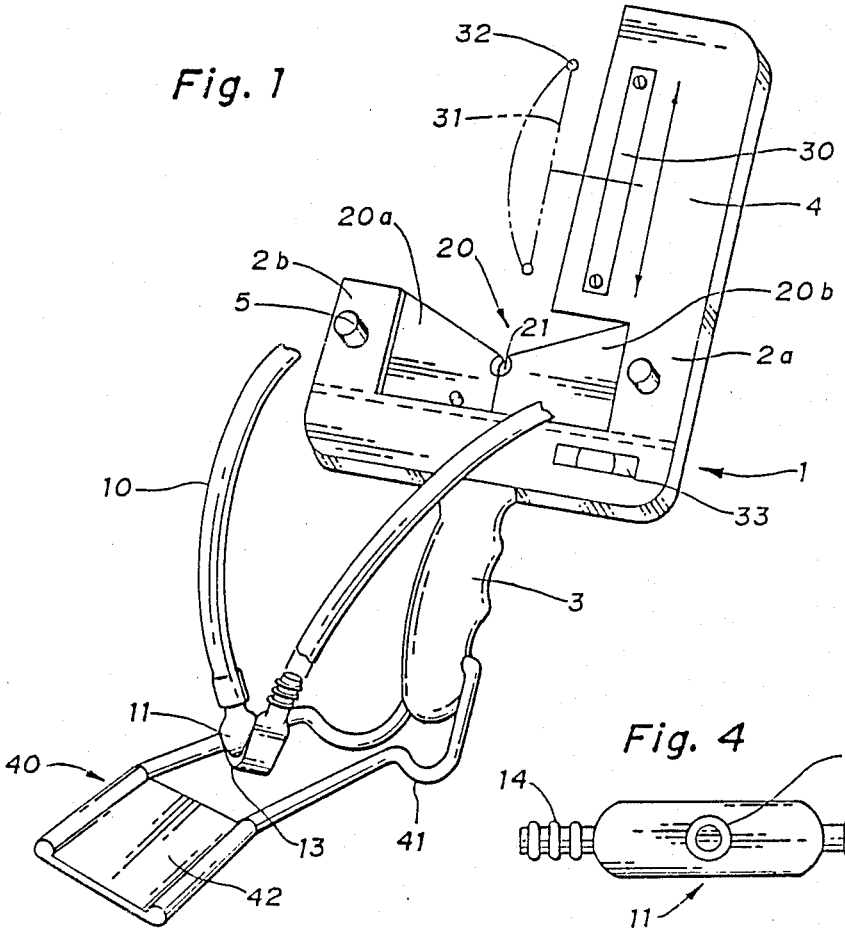
Fig. 4
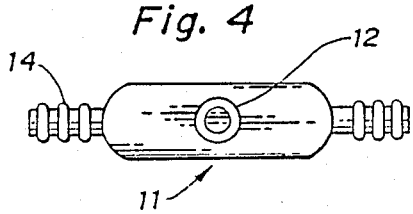
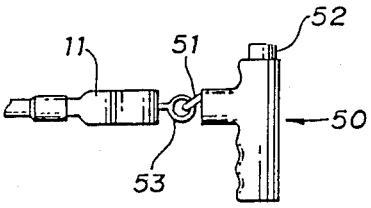
Fig. 3
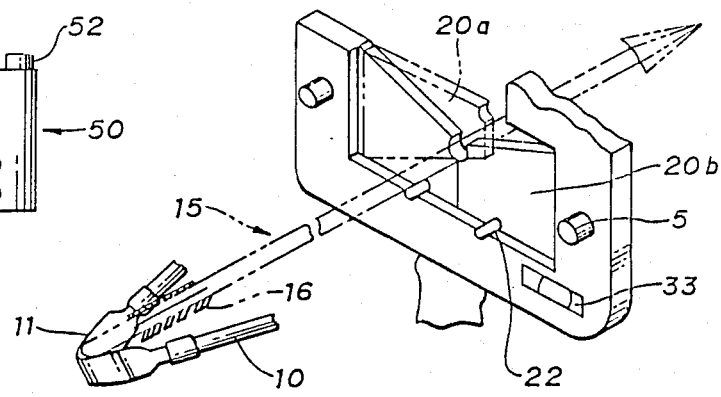
Fig. 2

ARROW SLING DEVICE, AND METHODS OF CONSTRUCTING AND UTILIZING SAME

BACKGROUND OF THE INVENTION

1. Field of the Invention

The present invention relates generally to an arrow sling device having a slingshot-type configuration adapted for loading and shooting arrows. More particularly, the invention relates a slingshot-type device having a main body provided with an arrow guiding portion and a sight member, and a resilient sling attached to the body and provided with a pouch for receiving and centering the rear end of an arrow.

2. Description of Relevant Art

An archer hunting in the woods is plaqued with the problem of having to transport the rather bulky bow with him (or her). This problem becomes particularly acute when fairly extensive travel on foot is necessary, or when swift and unobtrusive movement is required so as to avoid alerting the intended prey as to the hunter's presence.

To overcome this problem, there have been developed a number of devices which replace the standard archer's bow with a slingshot-type device. Although such known devices are less cumbersome than a bow, they present other limitations.

More particularly, each of the known devices is deficient in failing to meet one or both of the following demands: to permit convenient loading and gripping of the arrow, a slingshot-type device for shooting arrows should include an arrow-receiving member on the resilient sling member itself; and, to facilitate aiming, the device should be provided with a sight member.

Another deficiency of known devices concerns the arrow guiding member supported on the slingshot body. When the arrow is released to be propelled, the fletching, i.e., the feathered portion at the rear of the arrow for guiding the arrow through the air, is very likely to be damaged as it passes by the arrow guiding member.

The following devices exemplify the known arrangements:

The "Arrow Adapter Sling for Slingshots" disclosed in U.S. Pat. No. 2,613,659 issued in 1952 to Hutson comprises a slingshot adapter which allows arrows to be projected from conventional slingshots. The adapter comprises a support formed with an arrow seat and connected to the slingshot frame so as to extend upwardly between the two legs thereof.

The "Combination Arrow and Slingshot" disclosed in U.S. Pat. No. 2,691,973 issued in 1954 to Hutson comprises a slingshot having an arrow adapter connected to the slingshot frame so as to extend upwardly between the two legs thereof, in combination with a special arrow having a ball-shaped enlarged rear end to facilitate gripping thereof in the elastic sling of the slingshot.

The "Slingshot" disclosed in U.S. Pat. No. 2,715,895 issued in 1955 to Loveless is specially adapted for projecting arrows. A removable arrow support is connected to the slingshot frame so as to extend upwardly between the two legs thereof. Three resilient bands connected with the frame extend rearwardly and are connected with a conical pouch member which receives the rear end of an arrow.

French Pat. No. 1,500,802 issued in 1967 to Campana discloses a slingshot device comprising a body portion and an elastic sling portion. The body portion is formed with an aperture which guides an arrow as it passes therethrough, and is also formed with a larger aperture provided with a sight.

The present invention overcomes the above-discussed deficiencies attendant known arrangemments by providing an arrow sling device having a specially-adapted arrow guiding member (located on the slingshot body) which ensures that the fletching of the arrow will not be damaged as the arrow is shot. In addition, the present invention includes an adjustable sight member which affords precision accuracy in aiming, as well as a pouch member centrally located on the resilient sling to facilitate centering and gripping of a loaded arrow.

SUMMARY OF THE INVENTION

The present invention provides an arrow sling device comprising a body portion including spaced legs extending upwardly at respective sides of the body portion, and a grip handle extending downwardly from the body portion. Resilient sling means for propelling an arrow are connected with the body portion. Also connected to the body portion are arrow guide means and sight means for assisting aim, the sight means being supported by the body portion so as to be disposed above the arrow guide means.

In a preferred embodiment, the resilient sling means has an arrow pouch member centrally positioned therealong, the pouch member including means for centering a rear end of the arrow. Further, one of the legs of the body portion is provided with an upwardly-extending enlarged portion which supports a sight member in a vertically adjustable manner.

Preferably, the arrow guide means is defined by a pair of gate members hingedly secured at outer side edges thereof to the inner side of the legs of the body portion. The inner side edges of the gate members mate with and abut against each other to define an arrow guiding seat in a normally closed position of the gates. Upon release of a loaded arrow, as the fletching on the arrow contacts the gate members they will swing outwardly to avoid damage to the fletching.

The preferred embodiment also includes levelling means mounted on the body portion, and a removable arm support attached to a lower portion of the grip handle to provide greater stability when shooting.

An object of the present invention is to provide an arrow sling device which affords precision accuracy in aiming by including an adjustable sight member.

Other objects of the invention include convenience in loading and shooting, and protection of the arrow fletching during shooting.

Yet another object of the invention is to provide an arrow shooting device which is considerably less cumbersome than a conventional bow, and which is far less costly to produce.

The above and further objects, details and advantages of the invention will become apparent from the following detailed description, when read in conjunction with the accompanying drawings.

BRIEF DESCRIPTION OF THE DRAWINGS

FIG. 1 is a perspective view of the arrow sling device in accordance with a preferred embodiment of the invention.

FIG. 2 is a partially cut-away perspective view of the device of FIG. 1, shown in a loaded, full draw condition.

FIG. 3 is a side elevational view of an auxiliary arrow releasing means in accordance with the invention.

FIG. 4 is a front elevational view of the arrow pouch member shown in FIG. 1.

DETAILED DESCRIPTION OF PREFERRED EMBODIMENTS

With reference to FIG. 1, the arrow sling device in accordance with the invention includes a main body portion 1 having spaced legs 2*a*, 2*b* extending integrally upwardly from respective sides of body 1. A grip handle 3 extends downwardly from a central portion of body 1. Extending integrally upwardly from leg 2*a* is an enlarged portion 4 which supports the sight means according to the invention, as will be described in detail hereinbelow.

Preferably, the body 1 including legs 2*a*, 2*b* and enlarged portion 4, as well as grip handle 3, is fabricated of a strong, lightweight and rigid material. By way of example, such material may comprise wood, metal or high-strength plastic.

Exemplary dimensions for body 1 and grip handle 3 would be as follows: the width of enlarged portion 4, approximately 2¼"; the overall height of enlarged portion 4, approximately 8"; the height of legs 2*a*, 2*b*, approximately 2½" (from the top thereof to the bottom of body 1); the width of legs 2*a*, 2*b*, approximately 2½"; the width of handle 3, approximately 1"; and the length of handle 3 approximately 4".

A dowel 5 is mounted on each of the legs 2*a*, 2*b* for receiving, respectively, the ends of the two resilient sling sections 10. Although sling sections 10 are shown in FIG. 1 as comprising conventional rubber slingshot tubing, it will understood that the material used for sling sections 10 may alternatively comprise an elastic band material. In such case, the dowels 5 for connecting the ends of the sling sections to the body 1 would be replaced by any suitable fastening means, such as slits formed in legs 2*a*, 2*b*, for example.

With reference to FIGS. 1, 2 and 4, an arrow pouch member 11 is removably fastened to the outer ends of sling sections 10 so as to define a resilient sling means including the sections 10 and pouch 11. As shown in FIG. 4, the front surface of pouch 11 is provided with an integral annular member 12 projecting therefrom. Preferably, projection 12 is integrally molded in pouch 11 so as to mate with the nock impression provided at the rear end of an arrow. Projection 12 serves as an arrow centering and positioning member as will be described below.

As shown in FIG. 1, the portion 13 of pouch 11 extending behind projection 12 comprises a built-up reinforcing portion which will facilitate gripping of pouch 11 during loading and shooting operations, and will prevent premature wear of pouch 11. Extending from each side of pouch 11 is a knurled extension 14 adapted to receive the outer end of one of the sling sections 10 thereover. The extensions 14 may alternatively be formed with suitable fastening means for securing the outer ends of resilient band sling sections, if desired.

The pouch 11 is shown in the "full draw" or shooting position of FIG. 2 has a generally arcuate shape, and similarly is shown as arcuate in FIG. 1. In this respect, it is preferable that pouch 11 be integrally molded in such arcuate shape so as to minimize pinch on the loaded arrow. Arcuate pouch 11, including projection 12, reinforcement 13 and extensions 14, is desirably integrally molded of a somewhat resiliennt material such as rubber or plastic.

An arrow 15 (FIG. 2) for use with the arrow sling device according to the invention preferably comprises a lightweight aluminum arrow 15 with a specially-adapted fletching portion 16. The fletching 16 should preferably be defined by an annular series of feathers arranged so as to define unfeathered side clearance portions of the arrow shaft disposed proximal to the converging stretches of sling sections 10 when the arrow 15 is loaded as shown in FIG. 2. To this end, the fletching 16 may be moved forwardly approximately one inch from its normal position adjacent the rear end of arrow 16, and/or the annular series of feathered portions (e.g., four portions) may be circumferentially spaced to define such clearance portions on the arrow shaft.

With reference to FIGS. 1 and 2, the arrow guide means 20 provided on body 1 will now be described. Arrow guide means 20 preferably comprises a pair of gate members 20*a*, 20*b* which are symmetrically arranged relative to a vertical center line of body 1. Each of the gates 20*a*, 20*b* include a downwardly sloped upper edge which generally define a V-shaped configuration for the upper edge of mewans 20. Such construction facilitates positioning of the arrow shaft in the arrow guide means 20 as will be described below.

Formed centrally adjacent the upper edge of guide means 20 is an arrow seat aperture 21, which is defined by mating upper inside edge portions of the gates 20*a*, 20*b*. Below aperture 21, the inside edges of gates 20*a*, 20*b* matingly abut against each other as shown in FIG. 1. The aperture 21 is preferably formed so as to be slightly larger in diameter than the diameter of the arrow shaft, and is preferably bevelled. On its upper side, aperture 21 opens onto the upper edge of means 20 to permit the arrow shaft to be inserted downwardly therethrough into position within aperture 21. Preferably, apertures 21 is formed proximal to the lower portion of body 1, e.g., within approximately ⅝", so as to avoid undue strain on the writs of the user during shooting.

Each of the gates 20*a*, 20*b* is hingedly connected at the outer side edge thereof to an inside portion of a respective one of the legs 2*a*, 2*b*. The gates 20*a*, 20*b* are normally held in their closed or arrow guiding position shown in FIG. 1 by retainer means 22 (FIG. 2). Retainer means 22 may be of any desired construction, provided they exert just enough tension on gates 20*a*, 20*b* to normally hold same in the closed position but permit same to swing outwardly (shown in broken line in FIG. 2) when a loaded arrow is released to be propelled. More particularly, retainer means 22 are adapted to permit gates 20*a*, 20*b* to swing open when the arrow fletching 16 contacts aperture 21 upon release of the arrow, thus preventing fletching 16 from becoming damaged or misshapen. Where gates 20*a*, 20*b* are formed of metal, retainer means 22 may constitute magnets precisely positioned to permit the aforesaid opening action. Where gates 20*a*, 20*b* are formed of plastic or other non-metallic material (e.g. preferably plexiglass), retainer means 22 may constitute springs, rubber band retainers, friction posts, etc., suitably chosen to permit the aforesaid opening action.

The sight means according to the invention will now be described with reference to FIG. 1. Enlarged body portion 4 for supporting the sight means has a width dimension which is less than one-half the overall width dimension of body 1, so that the inner edge of portion 4 lies outwardly of the vertical center line of body 1. Enlarged portion 4 is provided with suitable fastening means, such as a strip 30 attached by screws, which provides adjustable fastening of a horizontal leg of an L-shaped sight post 31 therein. In this respect, it will be understood that fastener 30 permits selective vertical adjustment of sight post 31 in a range of positions extending between a lowermost position and an uppermost position, as indicated by the arrow in FIG. 1.

The sight post 31 supports on its outer end (i.e., on the end of the vertical portion thereof) a ball-shaped sight 32. As indicated by dashed lines in FIG. 1, post 31 with ball 32 is angularly movable through an angle of 180° to permit ball 32 to be selectively raised or lowered by pivoting post 31.

To further facilitate aiming, a conventional bubble-type level 33 is mounted on body 1. Level 33 can be used in conjunction with the sight means to furher enhance precision in shooting.

The sight means (and level 33) provides the user with precision aiming ability, thus avoiding any sacrifice in the normal precise aiming provided with a conventional bow. However, if the user prefers to rely on "instinctive" shooting, it is not necessary that the sight means and level 33 be used.

It is also contemplated that the sight means as described above may alternatively be replaced by a standard archery sight mounted on enlarged portion 4, if desired.

As shown in FIG. 1, it is also desirable that the arrow sling device be provided with a removable arm support member 40 including a pair of prongs 41 adapted to engage with suitable holes provided in grip handle 3. An arm support cuff 42 supported by prongs 41 is adapted to rest on the user's arm to provide stability during aiming and shooting operations.

If desired, the arrow sling device may also include an arrow releasing means 50 in the form of a handle member with finger grip portions. Mounted within means 50 is a trigger mechanism (not shown) which operates a hook 51 when a trigger button 52 is pushed. The pouch 11 would in this case be provided with a rearwardly extending hook-engaging member, such as an eyebolt 53. If desired, the inner end of eyebolt 53 could extend through to the inner side of pouch 11 to define an arrow seat, such as could be accomplished by employing a double nut and washer system, for example. Upon pushing trigger button 52, the hook 51 would be moved to release its engagement with eyebolt 53 to in turn release the arrow when shooting.

In using the FIG. 1 embodiment of the arrow sling device, the arrow 15 is loaded in the device by positioning the rear end of the arrow in projection 12 of pouch 11 and inserting a forward shaft portion of arrow 15 downwardly into guide aperture 21. At any desired point, suitable adjustments are made in the position of sight 32. The sling is retracted rearwardly to the full-draw position shown in FIG. 2, and precise aiming is made via sight 32 and/or level 33. The arrow is then released to be propelled, and as the fletching 16 contacts gates 20*a*, 20*b*, they will open outwardly to permit the arrow to pass unimpeded therethrough (shown in dashed in line FIG. 2).

It will be understood from the foregoing that because arrow pouch 11 is removably attached to the ends of sling sections 10, it can be easily replaced with another member designed for other types of shot (e.g., pellets, etc.). It is also contemplated that the arrow sling device can be readily converted for use by a child by increasing the resiliency of sling sections 10, either by using longer sections or more resilient ones. In such a child's version, the arm support 40 need not be provided, and special safe arrows provided with suction cups instead of points can be employed.

While there have been described what are at present considered to be the preferred embodiments of the invention, it will be understood that various modifications may be made therein without departing from the spirit of the invention. The present embodiments are therefore to be considered illustrative and not restrictive. The scope of the invention is indicated by the appended claims.

I claim:

1. An arrow sling device, comprising:

a body portion including spaced legs extending upwardly at respective sides of said body portion;

a grip handle extending downwardly from said body portion;

resilient sling means for propelling an arrow, said sling means being connected with said body portion;

arrow guide means supported by said body portion, said guide means comprising a pair of gate members each having an outer side edge thereof hingedly secured to an inner portion of one of said legs and an inner side edge thereof, one of said gate members inner side edge mates with and abuts against the inner side edge of the other of said gate members, said mating inner edges defining an arrow guiding seat when said gate members are in a closed position, and said gate members being swingable to an open position to prevent damage to a fletching of said arrow; and sight means for assisting aim.

2. An arrow sling device according to claim 1, wherein: said resilient sling means comprises:

an elongated resilient sling member secured at both respective ends thereof to said legs of said body portion, respectively; and an arrow pouch member removably connected to a central portion of said sling member, said pouch member including means for centering a rear end of an arrow therein.

3. An arrow sling device according to claim 2, wherein:

said sling member comprises two resilient sling sections each having a first end thereof secured to one of said legs and a second end thereof secured to said pouch member;

said centering means comprises an annular projection extending from a central front surface of said pouch member; and said pouch member includes a reinforcement portion disposed rearwardly of an annular projection.

4. An arrow sling device according to claim 1, wherein:

one of said legs of said body portion is provided with an upwardly-extending enlarged portion; and said sight means comprises a sight member supported by said enlarged portion so as to be selectively vertically adjustable in a range of positions between a lowermost position and an uppermost position.

5. An arrow sling device according to claim 4, wherein:

said sight member comprises a substantially L-shaped post having a ball-shaped sight secured at an outer end thereof;

said enlarged portion is provided with fastening means adapted to receive an inner end of said L-shaped post for selectively fastening said sight member at a desired position in said range of positions; and said sight member, when fastened in any one of said positions, is selectively rotatable through a 180° angle between a position wherein said sight is raised and a position wherein said sight is lowered.

6. An arrow sling device according to claim 5, wherein:

said enlarged portion has a width dimension which is less than one-half the overall width dimension of said body portion; and said sight member, when fastened in any one of said positions, is disposed substantially on a vertical center line of said body portion.

7. An arrow sling device according to claim 6, wherein:

said upper edge of said arrow guide means is sloped downwardly from respective side edges thereof so as to be generally V-shaped; and said central aperture is bevelled, and has an upper open portion opening onto said upper edge to permit the shaft of an arrow to be inserted therethrough.

8. An arrow sling device according to claim 7, wherein:

said arrow guide means further comprises retainer means for normally holding said gate members in said closed position to permit an arrow to be guided through said central aperture; and said retainer means is adapted to permit said gate members to move to said open position thereof when an arrow is propelled by said sling means.

9. An arrow sling device according to claim 1, wherein:

a levelling means is integrally attached to a lower part of said body portion so as to be visible to a user when said device is in an operable shooting position.

10. An arrow sling device according to claim 1, wherein:

an arm support member is removably attached to a lower portion of said grip handle, said arm support member including a support cuff adapted to rest on a user's arm.

11. An arrow sling device according to claim 2, wherein:

said device further comprises arrow releasing means operably cooperating with said arrow pouch member.

12. An arrow sling device according to claim 11, wherein:

said arrow releasing means comprises a handle portion having a trigger mechanism mounted therein;

said trigger mechanism operatively cooperates with a hook member extending from said handle portion;

said pouch member is provided with a hook-engaging member extending from a rear central portion thereof, said hook-engaging member having said hook member engaged therewith in a loaded condition of said arrow releasing means; and said trigger mechanism is adapted to selectively release said hook member from engagement with said hook-engaging member to permit an arrow to be propelled by said sling means.

13. An arrow sling device according to claim 1, further comprising:

an arrow adapted to be loaded in said device, said arrow having an annular series of feathers secured to a shaft portion thereof adjacent a rear end of said arrow; and said feathers being arranged so as to define unfeathered side clearance portions of said shaft disposed proximal to converging stretches of said resilient sling means when said arrow is loaded in said device.

14. An arrow sling device, comprising:

a body portion including spaced legs extending upwardly at respective sides of said body portion;

a grip handle extending downwardly from said body portion;

resilient sling means for propelling an arrow, said sling means being connected with said body portion;

arrow guide means comprising a pair of gates supported on said spaced legs for guiding a shaft portion of an arrow loaded on said device; and retainer means for normally holding said arrow guide means in a guiding position wherein said arrow is guided by said arrow guide means, and for permitting said arrow guide means to automatically move to an open release position when said arrow is propelled by said sling means.

15. An arrow sling device according to claim 14, wherein: said pair of gate members hingedly secured to said spaced legs at outer side edges of said gate members;

each of said gate members has an inner side edge which mates with and abuts against the inner side edge of the other of said gate members when said arrow guide means is disposed in said normal guiding position; and said inner side edges of said gate members are swung outwardly in said open release position.

16. An arrow sling device according to claim 15, wherein:

each of said gate members has a sloped upper edge which is inclined downwardly towards said inner side edge; and in said normal guiding position, mating upper portions of said inner side edges of said gate members define an arrow seat aperture which opens on said upper edges.

17. An arrow sling device according to claim 16, further comprising:

sight means for assisting aim, said sight means being supported by said body portion so as to be disposed above said arrow guide means; and said arrow seat aperture and said sight means being disposed on a vertical center line of said body portion.

18. An arrow sling device according to claim 16, wherein:

said resilient sling means comprises:

an elongated resilient sling member secured at both respective ends thereof to said body portion; and an arrow pouch member connected to a central portion of said sling member, said pouch member including means for centering a rear end of an arrow therein.

* * * * *